United States Patent [19]

Remington

[11] Patent Number: 4,523,167

[45] Date of Patent: Jun. 11, 1985

[54] BISTABLE ELECTROMAGNETIC LATCH

[75] Inventor: Richard C. Remington, Pompton Plains, N.J.

[73] Assignee: Presto Lock, Inc., Garfield, N.J.

[21] Appl. No.: 453,130

[22] Filed: Dec. 27, 1982

[51] Int. Cl.[3] ..... H01F 7/08

[52] U.S. Cl. ..... 335/230; 335/272

[58] Field of Search ..... 335/234, 253, 254, 266, 335/268, 272, 229, 230; 340/815.25, 815.26

[56] References Cited

U.S. PATENT DOCUMENTS

| | | | |
|---|---|---|---|
| 3,001,107 | 9/1961 | Rhodes | 335/272 |
| 3,304,526 | 2/1967 | Adams | 335/230 |
| 3,543,202 | 11/1970 | Naybor | 340/815.26 |
| 3,694,782 | 9/1972 | Ray | 335/272 |
| 4,227,164 | 10/1980 | Kitahara | 335/230 |

FOREIGN PATENT DOCUMENTS

| | | | |
|---|---|---|---|
| 3005921 | 9/1981 | Fed. Rep. of Germany | 335/272 |

*Primary Examiner*—E. A. Goldberg
*Assistant Examiner*—George Andrews
*Attorney, Agent, or Firm*—Shapiro and Shapiro

[57] ABSTRACT

A bistable electromagnetic latch, particularly adapted for use with an electronic combination lock on a luggage case, comprises a magnetic member pivotally mounted for rotation between a pair of pole pieces, the magnetic member having first and second stable rotational positions at which each magnetic pole is adjacent to a different pole piece, and a pair of oppositely wound coils associated with the pole pieces and responsive to the momentary flow of electrical current therethrough for producing a magnetic flux that causes the magnetic member to rotate from one position to the other.

4 Claims, 5 Drawing Figures

BISTABLE ELECTROMAGNETIC LATCH

BACKGROUND OF THE INVENTION

This invention relates generally to electromagnetically operated latching mechanisms, and more particularly to a bistable electromagnetic latch especially adapted for use with an electronic combination lock employed on luggage and the like.

Electronic combination locks may comprise electronic circuits for storing a predetermined combination, push buttons which enable a user to enter a selected combination into the lock, and means for comparing the stored and entered combinations. If the combinations match, an electromagnetic device, such as a solenoid, may be energized to open a latching mechanism. If the electronic combination lock is battery operated, as it would be, for example, if used on a luggage case, it is desirable to minimize power consumption. If the solenoid requires large amounts of power for its operation or must remain energized in order to be held in an activated position, this results in low battery life. Accordingly, such devices are not well adapted for battery operated electronic locks.

SUMMARY OF THE INVENTION

The invention provides an electromagnetic latch which may be used with an electronic combination lock and which avoids the foregoing disadvantage.

Briefly stated, an electromagnetic latch in accordance with the invention may comprise a magnetic member having first and second magnetic poles and being rotatable between first and second pole pieces, the magnetic member having first and second stable rotational positions at which the first and second magnetic poles are adjacent to a different pole piece, coil means associated with the pole pieces and responsive to the momentary flow of electrical current therethrough for producing a magnetic flux that causes the magnetic member to move from one position to the other, and means connected to the magnetic member and movable therewith for controlling an associated latch mechanism.

DESCRIPTION OF THE PREFERRED EMBODIMENT

Bistable electromagnetic latches in accordance with the invention are especially well adapted for use with electronic locks on luggage and the like, and will be described in that environment. However, as will be appreciated, this is illustrative of only one utility of the invention.

Figure 1:
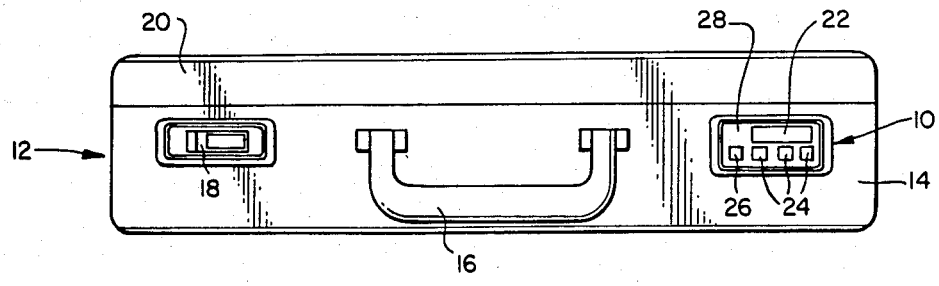
FIG. 1 is an elevational view illustrating an electronic lock on a luggage case.

FIG. 1 illustrates one manner in which an electronic lock 10 may be used on a luggage case 12. As shown, the electronic lock may be disposed on an exterior surface of a sidewall 14 of the luggage case on one side of a carrying handle 16, and a manually operable actuator 18 may be disposed on the sidewall on the opposite side of the handle. The actuator may be slidable and may be coupled to a luggage latching mechanism (not illustrated) disposed on the interior surface of the sidewall. The latching mechanism may comprise, for example, spaced latch members slidably or pivotally mounted within the case on the sidewall and engageable with associated hasps disposed on the interior surface of the lid 20 of the case for holding the parts of the case together. The latches may be coupled to the actuator by one or more control members arranged to move the latches to unlatching position when the actuator is operated. As will be described in more detail shortly, the electronic lock includes means for controlling the operation of the electromagnetic latch of the invention (not shown in FIG. 1), which in turn includes means for controlling the luggage latching mechanism as by blocking the movement of the actuator or a control member when the lock is off combination (locked) and permitting such movement when the lock is on combination (unlocked). The precise arrangement of the luggage latching mechanism and the precise manner in which it is controlled by the electromagnetic latch are not important to the invention. It will become apparent that the electromagnetic latch may be adapted readily to control different latching mechanisms.

Figure 2:
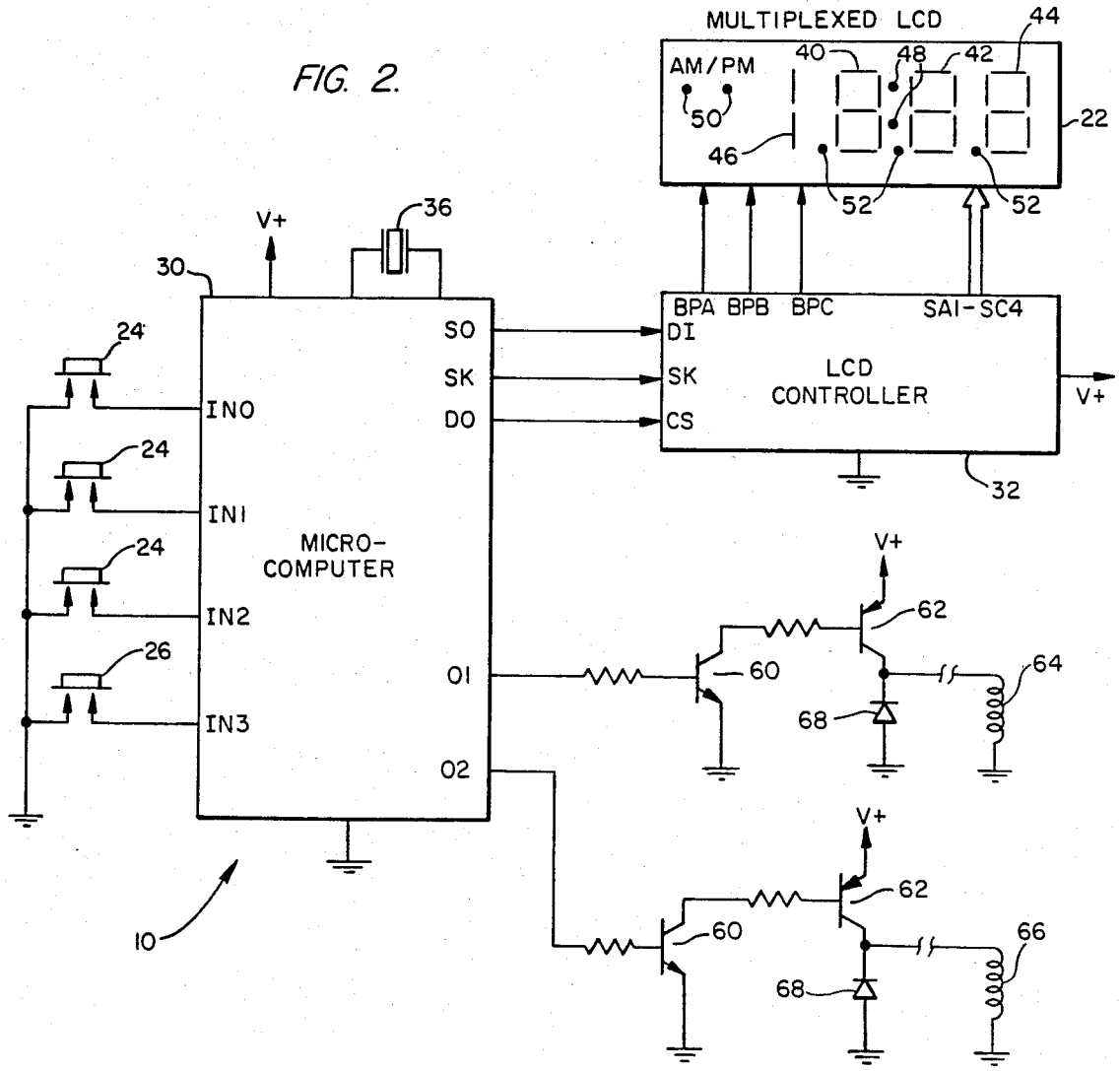
FIG. 2 is a block diagram of the electronic lock of FIG. 1.

Briefly, as shown in FIG. 1, the electronic lock may comprise a display 22 for displaying combination indicia, e.g., digits, or time of day, and a plurality of push buttons 24, 26 for entering combinations and for controlling the lock, all disposed on a faceplate 28. As shown in FIG. 2, the electronic lock may comprise a microcomputer 30; and display 22 may be a multiplexed liquid crystal display (LCD) controlled by the microcomputer via an LCD controller 32.

The microcomputer may include an internal clock oscillator that is crystal controlled by a 32 KHz watch crystal 36, an internal ROM for storing control programs that control the operation of the lock, and an internal RAM for storing a user-entered combination. (The internal components are not illustrated in the figure.) The microcomputer may have four inputs IN-0–IN3 which are connected to push buttons 24 and 26, as illustrated, and may have outputs SO, SK, and DO which respectively provide serial data, serial clock, and a chip select signal to corresponding inputs DI, SK, and CS of controller 32. The controller has outputs BPA, BPB, and BPC which provide signals to corresponding backplanes of the LCD, and has 12 multiplexed outputs SA1-SC4 for driving segments of the LCD.

The display may have a plurality of display locations 40, 42, and 44 for displaying either a three-digit combination entered by push buttons 24, or which may be used with another display location 46 (for the digit "1") for displaying time of day. A pair of dots 48 between display locations 40 and 42 are used in the time mode to separate the hours and minutes portions of the display, and a pair of dots 50 in the upper left of the display may be employed for indicating A.M. or P.M. The three dots 52 adjacent to display locations 40, 42, and 44 may be used in combination-changing and time-set modes.

Microcomputer 30 further has a pair of outputs 01 and 02, each connected to a driver circuit comprising, as shown, a pair of transistors 60, 62, for driving respective coils 64, 66 of the electromagnetic latch of the invention as will be described shortly. Output 01 may issue an output signal to coil 64 for unlatching the electromagnetic latch, and output 02 may issue a signal to coil 66 for latching the latch. When either output goes high, its associated transistors 60, 62 conduct allowing current to flow through the associated coil. As shown, each coil may be shunted by a diode 68 for suppressing negative voltage transients.

Figure 3:
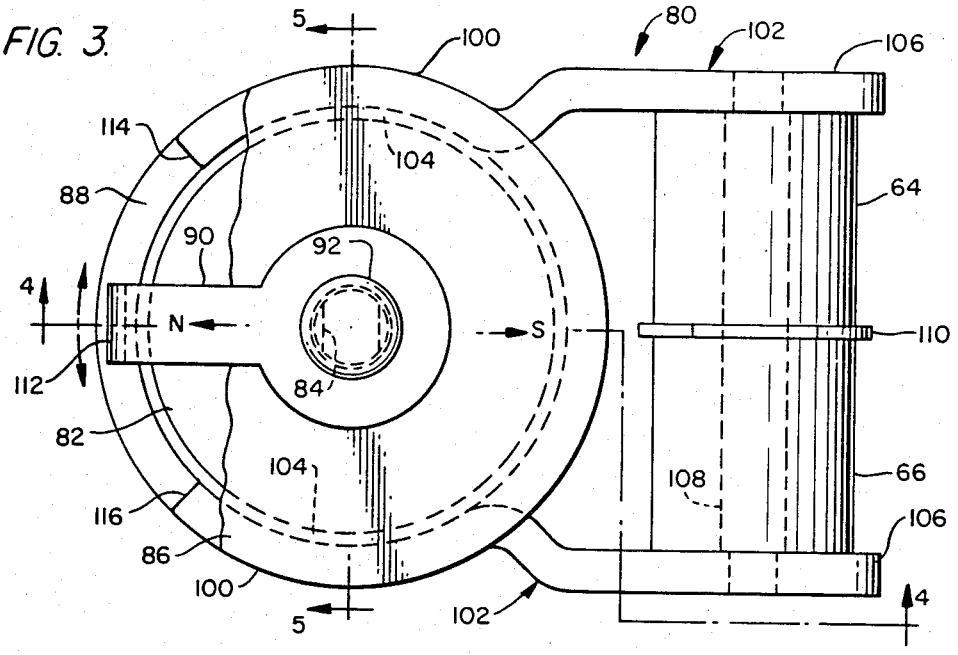
FIG. 3 is a top view, partially broken away, of a bistable electromagnetic latch in accordance with the invention.
Figure 4:
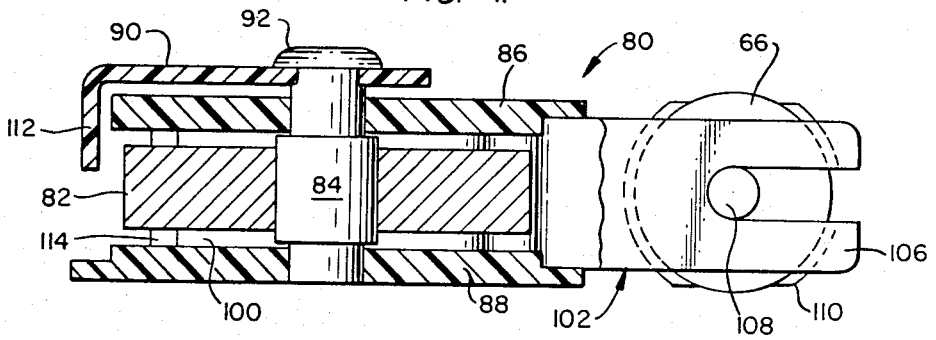
FIG. 4 is a longitudinal sectional view taken approximately along the line 4—4 of FIG. 3.
Figure 5:
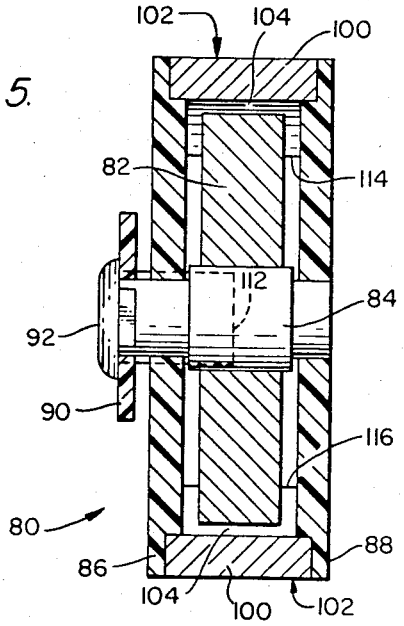
FIG. 5 is a transverse sectional view taken approximately along the line 5—5 of FIG. 3.

FIGS. 3-5 illustrate a preferred form of a bistable electromagnetic latch 80 in accordance with the invention that may be employed with the electronic lock. As shown, the electromagnetic latch may comprise a magnetic rotor such as a disc magnet 82 that is polarized across one diameter to provide diametrically opposed north (N) and south (S) poles on its periphery. The disc magnet is pivotally supported for rotation about its axis by a rotatable shaft 84 supported between a pair of generally planar nonmagnetic support brackets 86 and 88, as best shown in FIG. 4. An angled non-magnetic stop member 90 may be connected to one end of the shaft, as by a rivet 92, so that it rotates with the disc magnet and so that it is aligned with the magnetized diameter of the disc magnet, as shown in FIG. 3.

The arcuate portions 100 of a pair of soft iron pole pieces 102 may be disposed on opposite sides of the disc magnet, as shown in FIG. 3, and held in position by the support brackets 86 and 88 so as to provide a small air gap 104 between the periphery of the disc magnet and the pole pieces. Each pole piece may have an extended portion 106 that supports one end of a soft iron coil core 108 upon which coils 64 and 66 are wound. An insulated spacer 110 may be located between the coils.

As shown in FIG. 3, the ends 114 and 116 of the arcuate portions 100 of the pole pieces define a circumferentially extending magnetic gap therebetween that preferably subtends an angle of the order of 90°. The opposite ends of the arcuate portions, i.e., at the connection of the arcuate portions to extended portions 106, define another circumferentially extending magnetic gap on the opposite side of the disc magnet that preferably subtends the same angle as that of the gap between ends 114 and 116. One magnetic pole of the rotor rotates between the ends of one magnetic gap, and the other magnetic pole rotates between the ends of the other magnetic gap. The angled portion 112 of the stop member 90 is located within the gap defined by ends 114 and 116 of the pole pieces. The ends function as stops and cooperate with the angled portion 112 to limit the rotation of the disc magnet. The magnet, the pole pieces, and the soft iron coil core form a magnetic circuit, and since the magnetic flux produced by the disc magnet prefers to take the path of least reluctance, forces will be exerted on the disc magnet to cause its north and south poles to assume positions adjacent to the pole pieces. Although in FIG. 3 stop member 90 is shown positioned midway between stops 114 and 116, this is an unstable position since any slight jar or disturbance would cause the magnet to rotate and portion 112 to snap into engagement with either stop 114 or stop 116.

The two rotational positions of the magnet at which the stop member engages the ends of the pole pieces, i.e., stops 114, 116, are stable positions at which the north pole of the magnet is adjacent to the end 114 or 116 of one of the pole pieces and the south pole of the magnet is adjacent to the arcuate portion 100 of the other pole piece near its extended portion 106. The magnet will remain in a stable position without any power being applied to coils 64 or 66, and will resist movement away from either stop because of the magnetic forces exerted on it. In fact, the magnet will snap back to a stop position if rotated less than half of its stroke, i.e., to the midway position of FIG. 3, and released. As noted hereinafter, the two stable positions correspond to locked and opened positions of the electromagnetic latch.

Coils 64 and 66 may be wound in opposite directions on the soft iron coil core 108 so that when a DC voltage is applied to coil 64 the polarity of the magnetic flux produced across the pole pieces is opposite to that produced when coil 66 is energized. Accordingly, if coil 64 is energized and the disc magnet 82 is in a rotational position such that the magnetic flux produced by coil 64 and the magnetic flux produced by the magnet are of the same polarity, the magnet will snap to its other stable position where the polarities are opposite. Subsequent voltage pulses (of the same polarity) on coil 64 will have no effect on the rotational position of the magnet. However, if a DC voltage (of the same polarity as that applied to coil 64) is next applied to coil 66, the resulting magnetic flux across the pole pieces will have an opposite polarization to that produced by coil 64, and will cause the magnet to snap back to its initial position. Accordingly, energizing one coil will cause the disc magnet to snap to one stable position, and subsequently energizing the other coil will cause it to snap to the other position. As noted above, energizing the same coil a second or more times will not cause a change in the state of the electromagnetic latch. Therefore, accidentally energizing the wrong coil will not cause the latch to latch when it should be opened or to open when it should be latched. Of course, a single coil energized by opposite polarity voltage sources may also be employed for controlling the latch.

The electromagnetic latch can be switched from one stable position to the other using only a momentary voltage pulse. Once it is switched, it is magnetically latched in position and will remain in that position without the necessity for the further application of electrical power. Thus, electrical power is conserved, which is important when using batteries as a power source. A voltage pulse of the order of 0.5 second or less is capable of switching the electromagnetic latch from one position to the other. Assuming four 1.5 volt alkaline pen light batteries as a power source and a coil resistance of 64 ohms, the coil current would be 0.094 amps, which would generate approximately 182 ampereturns of magnetomotive force for coils having approximately 1,950 turns. This would enable the case to be locked and unlocked approximately 10,000 times over a one-year period while still having one-half of the rated power remaining in the batteries. Because of its symmetrical design, the rotary disc magnet is balanced about its pivotal axis and is highly resistant to shock and vibration. Moreover, because of its simple design, the electromagnetic latch is low in cost.

The electromagnetic latch may be coupled to a latching mechanism to control it in many different ways. For example, a tab could be associated with stop member 90 so that in one position of the latch the tab would enter an area that would block the movement of an actuator or some other movable member of the latching mechanism. Also, the stop member itself may be used directly for this purpose. Preferably, the latch is interfaced with the latching mechanism so that in its quiescent state no component of the latching mechanism engages the tab, the stop member or any other portion of the disc magnet (except when the latching mechanism is operated and the electromagnetic latch is in blocking position), since this would add additional friction which would have to be overcome for switching. Of course, the latch may also be interfaced with the latching mechanism using other arrangements employing cams, levers or rods. However, this may add friction and mechanical load to the latch, which would result in higher current drain and reduced battery life.

As indicated earlier, the operation of the electronic lock 10 may be controlled by the microcomputer 30 (FIG. 2) in accordance with the programs stored in its ROM. More details of the operation of the electronic lock may be had by referring to the co-pending application of Richard C. Remington and Lonnie C. Bott, Ser. No. 453,131 filed concurrently herewith and assigned to the same assignee as the present invention, the disclosure of which is incorporated by reference herein. Suffice it to say that upon the electronic lock being set on combination using push buttons 24 and push button 26 being depressed, the microcomputer output 01 goes high for a predetermined period of time, e.g., 0.5 second, and causes a positive voltage pulse to be applied to coil 64 to switch the electromagnetic latch to its unlatched (non-blocking) position. Depressing any of the push buttons 24 when the electronic lock is on combination causes output 02 to go high for the predetermined period of time, which applies a positive voltage pulse to coil 66 to switch the electromagnetic latch to its latched (blocking) position. Of course, the electromagnetic latch also may be controlled by other devices which produce voltage pulses for energizing the coils for switching.

While a preferred embodiment of the invention has been shown and described, it will be apparent to those skilled in the art that changes can be made in this embodiment without departing from the principles and spirit of the invention, the scope of which is defined in the appended claims.

The invention claimed is:

1. An electromagnetic latch comprising a magnetic circuit including a pair of magnetic pole pieces, each pole piece having an arcuate portion and a further portion, a permanent magnet rotor supported for rotation about an axis centered between said arcuate portions with said arcuate portions embracing said rotor, said arcuate portions each having first ends not merging into said further portions and spaced to define the respective ends of a first magnetic gap and each having second ends merging into said further portions, respectively, and defining respective ends of a second magnetic gap, said gaps subtending substantially equal angles about said axis, said magnetic rotor having opposite magnetic poles associated with said magnetic gaps, respectively, each magnetic pole being rotatable between the ends of the associated magnetic gap, whereby alternate magnetic paths of low reluctance and corresponding stable positions of the rotor are defined when each magnetic pole of the rotor is adjacent to either end of the associated magnetic gap, and coil means connected to said further portions of said pole pieces and responsive to the momentary flow of electrical current therethrough for producing a magnetic flux in the magnetic circuit that causes the rotor to move from one stable position to the other.

2. An electromagnetic latch in accordance with claim 1, wherein said rotor has means engaging the ends of one of said magnetic gaps for mechanically stopping rotation of said rotor at said stable positions.

3. An electromagnetic latch in accordance with claim 1, wherein said rotor is a disk, wherein said coil means is supported between said further portions of said magnetic pole pieces, and wherein the entire magnetic circuit forms a substantially flat configuration between parallel planes.

4. An electromagnetic latch in accordance with claim 1, wherein said gaps subtend angles about the axis of the rotor that are of the order of 90°.

* * * * *